United States Patent [19]

King

[11] 4,304,170

[45] Dec. 8, 1981

[54] LOCKING ASSEMBLY FOR A ROCKET AND LAUNCH TUBE

[75] Inventor: David W. King, Seattle, Wash.

[73] Assignee: The Boeing Company, Seattle, Wash.

[21] Appl. No.: 30,109

[22] Filed: Apr. 16, 1979

[51] Int. Cl.[3] ..... F41F 3/04

[52] U.S. Cl. ..... 89/1.807; 89/1.816

[58] Field of Search ..... 89/1.806, 1.807, 1.812, 89/1.816

[56] References Cited

U.S. PATENT DOCUMENTS

| | | | |
|---|---|---|---|
| 2,830,497 | 4/1958 | Smoot et al. | 89/1.806 |
| 2,831,400 | 4/1958 | Hösli | 89/1.806 |
| 2,846,924 | 8/1958 | Doak et al. | 89/1.806 |
| 2,848,925 | 8/1958 | Hood | 89/1.806 |
| 3,076,385 | 2/1963 | Bornhöft | 89/1.806 |
| 3,296,929 | 1/1967 | Jacobson | 89/1.806 |
| 3,754,726 | 8/1973 | Rusbach | 89/1.806 X |
| 4,132,150 | 1/1979 | Conn | 89/1.806 |

FOREIGN PATENT DOCUMENTS

| | | | |
|---|---|---|---|
| 1340562 | 9/1963 | France | 89/1.806 |
| 388139 | 6/1965 | Switzerland | 89/1.806 |
| 592861 | 11/1977 | Switzerland | 89/1.806 |
| 1182275 | 2/1970 | United Kingdom | 89/1.806 |

*Primary Examiner*—David H. Brown

*Attorney, Agent, or Firm*—Hughes, Barnard & Cassidy

[57] ABSTRACT

A pair of locking members to releasably lock a rocket in a launch tube. Each locking member has a forward end engaging the rocket and a rear end engaging the tube. A retaining strut engages the two rear ends of the locking members to hold the locking members in locking engagement. When the rocket is fired, the exhaust from the rocket moves the retaining strut out of retaining engagement to permit leaf springs on the locking members to pivot the locking members out of locking engagement and permit the rocket to move out of the tube.

31 Claims, 7 Drawing Figures

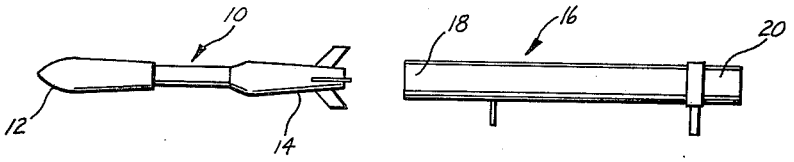
FIG. 1
FIG. 2
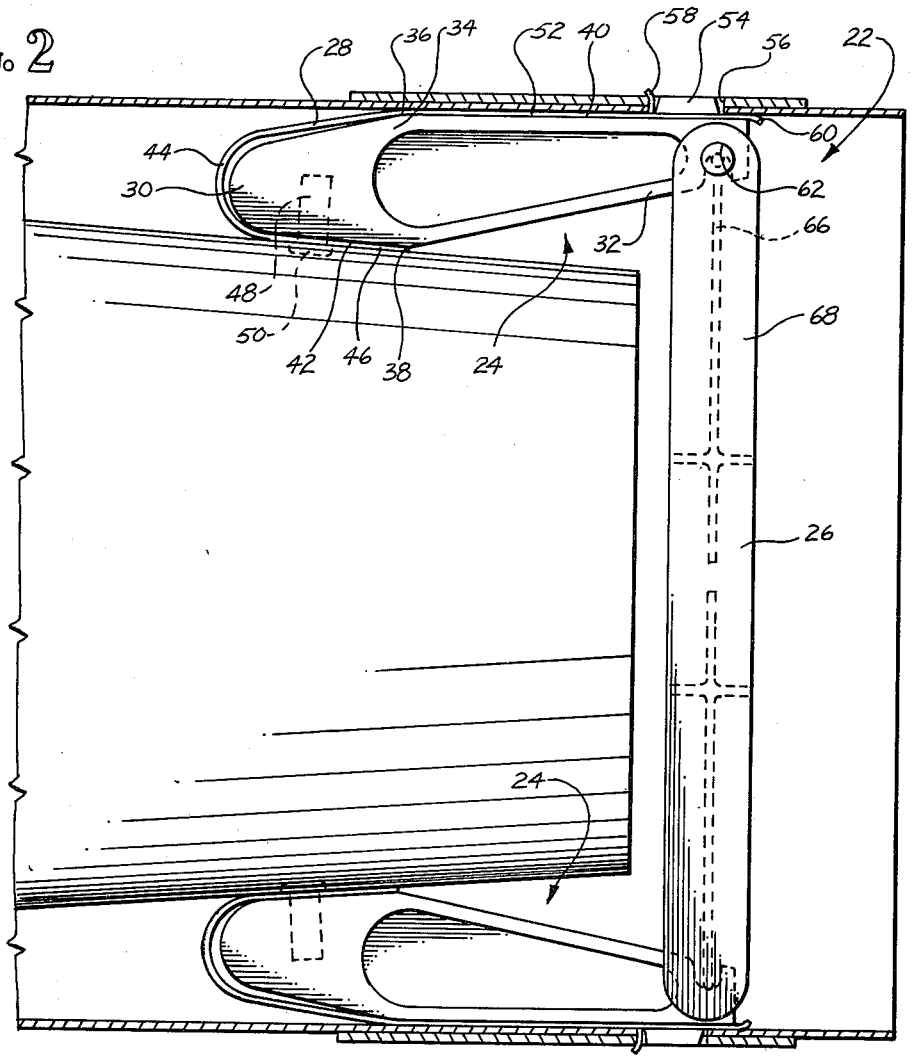

LOCKING ASSEMBLY FOR A ROCKET AND LAUNCH TUBE

BACKGROUND OF THE INVENTION

The present invention relates to a locking assembly to retain a rocket in a launch tube.

It is a common practice to securely lock a rocket in a disposable launch tube so that the launch tube, with the rocket therein, can be carried to the location of use. Upon firing the rocket, the locking mechanism releases the rocket so that the rocket can travel from the tube. The following devices were noted in a search of the prior art and are believed to be representative of the prior art releasable locking mechanisms for rockets.

U.S. Pat. No. 2,830,497, Smoot, shows a pivotally mounted locking member which is held in its locking position by an elongate spring member. Upon firing of the rocket, the rocket moves forwardly, pivoting the locking member against the urging of the spring so as to rotate the locking member to its release position.

U.S. Pat. No. 2,831,400, Hösli, disclosed a release mechanism for a rocket where there are a pair of locking members pivotally mounted in a manner that the swing ends of the locking members extend around the rear end of the rocket. Firing of the rocket causes the exhaust gases to push a release element against the locking members to pivot them outwardly and release the rocket.

U.S. Pat. No. 2,846,924, Doak Jr. et al., discloses a rocket retaining member pivotally mounted to the outside of a launch tube. One end of the retaining member is urged outwardly by a compression spring to force an opposite end of a retaining member into retaining engagement with a tapered surface of the rocket. When the rocket is fired, forward movement of the rocket pushes the retaining element against the urging of the spring so that the rocket can be released.

U.S. Pat. No. 2,848,925, Hood, shows a retaining member for a rocket which has a forward portion fixedly attached to a launch tube, and a rear portion extending radially inwardly and rearwardly adjacent the exhaust end of the rocket. The retaining member has an intermediate locking portion which engages the rocket. When the rocket is fired, the gaseous exhaust engages the rear portion of the retaining element to push it radially outwardly and thus move the middle retaining portion also radially outwardly to release the rocket.

U.S. Pat. No. 3,076,385, Bornhöft, discloses a retaining element for a rocket mounted adjacent the exhaust end of the rocket. There is an upstanding release member pivotally mounted to stationery structure and having a radially outwardly extending locking element engaging a mating locking element on the rocket. When the rocket is fired, the gaseous exhaust rotates the retaining element to move its locking element against the resistance of an overcenter device to release the rocket.

U.S. Pat. No. 3,754,726, Rusbach, illustrates a locking device where there are a plurality of pivotally mounted locking elements mounted to the exhaust end of the rocket. These locking elements are spread radially outwardly by a closure cap mounted to the exhaust end of the rocket. When the rocket is fired, the closure cap is blown rearwardly to release the locking elements. As the rocket moves forwardly in the tube, the locking elements slide out of locking engagement.

SUMMARY OF THE INVENTION

The locking assembly of the present invention is designed to reliably hold a rocket in its launch tube during storage and transport of the rocket in the tube, and to reliably and quickly release the rocket from the tube when the rocket is fired. The launching tube has a forward launching end and a rear exhaust end, and the rocket likewise has a forward end and a rear exhaust end.

The locking assembly comprises at least one locking member mounted to the tube and having a first engaged position where the locking member engages the rocket in locking relationship, and a second release position where the locking member releases the rocket for launch. There is spring means urging the locking member toward its disengaged position.

To hold the locking member in its locking position, there is a retaining member having a retaining position in which it holds the locking member in the locking position in opposition to the spring means. This retaining member is further characterized in that it has a release portion thereof mounted adjacent the exhaust end of the rocket in a manner that exhaust from the rocket causes movement of the release portion to move the retaining member from its retaining position, so as to permit the spring means to move the locking member to its disengaged position.

Thus, prior to firing the rocket, the locking member reliably holds the rocket in the tube. Upon firing of the rocket, exhaust gases from the rocket move the retaining member from its retaining position to permit the spring means to move the locking member to its disengaged position and thus permit the rocket to be launched from the tube.

In the preferred form, the locking member is pivotally mounted in the tube in a manner to have a first swing end and a second swing end. The first swing end has a locking element thereon engaging the rocket and moveable in a radially outward direction toward the release position. The second swing end is urged by the spring member in a radially inward direction toward the release position. The retaining member normally engages the second swing end in a manner to prevent the second swing end from moving inwardly when the retaining member is in its retaining position. Thus upon the retaining member being moved from its retaining position, the spring means causes the second swing end to swing inwardly, thus causing the first swing end to move outwardly to the release position.

In the preferred specific configuration, the locking member is positioned between an inner surface of the tube and an outer surface of the rocket. The locking member has a middle portion of greater dimension in a radial direction, with the first swing end and second swing end both having smaller dimensions in a radial direction. Thus the locking member is pivotally mounted within the tube by means of its middle portion pivotally engaging the tube and the rocket.

Desirably, in the locking position the locking element extends radially inwardly from the first swing end to engage the rocket.

In the preferred form, the spring means comprises a resilient spring member mounted to the locking member and extending from the middle portion of the locking member toward the second swing end of the locking member. The spring member is yieldingly urged to a position away from the second swing end and positioned between the tube and the locking member, in a manner that the spring member urges the second swing end of the locking member radially inwardly. Preferably, the spring member comprises a leaf spring attached to the first swing end of the locking member and extending across the middle portion of the locking member toward the second swing end of the locking member.

The spring member has a retaining finger releasably engaging the tube. The spring member is so arranged that when the locking member is moved toward its release position, the retaining finger is moved out of engagement with the tube. The tube is provided with a retaining recess, and the second swing end of the locking member has a second locking element positioned in the recess when the locking member is in its locking position. Preferably, the retaining finger is also positioned in the locking recess, in a manner that upon release by the retaining member, the spring member first moves said second locking element out of engagement with the locking recess, and thereafter the releasable locking finger moves out of engagement with the locking recess.

Preferably, there are two locking members positioned so as to be diametrically opposed on opposite sides of the rocket. The retaining member extends between the two swing ends of the opposed locking members to hold both locking members in their locking position, with the retaining member being positioned rearwardly of the exhaust end of the rocket.

Other features of the present invention will become apparent from the following detailed description.

BRIEF DESCRIPTION OF THE DRAWING

FIG. 1 illustrates a typical rocket and launch tube for which the present invention is used;

FIG. 2 is a longitudinal view of the aft end of a launch tube and rocket, employing the present invention, the launch tube being shown in section;

DESCRIPTION OF THE PREFERRED EMBODIMENT

Figure 3:
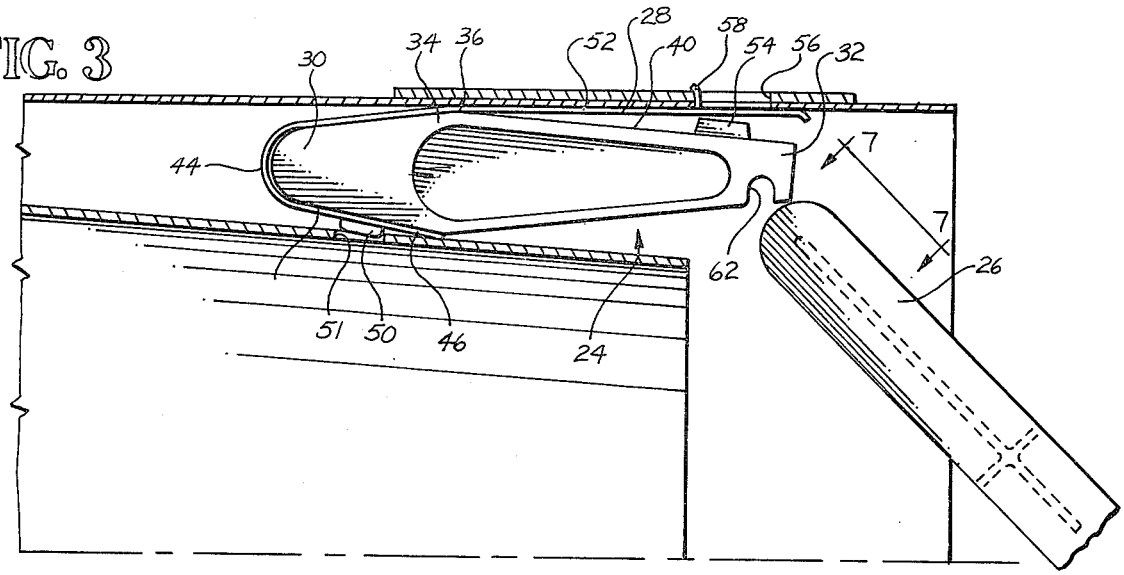
FIGS. 3, 4 and 5 show the upper portion of the apparatus shown in FIG. 2, with these three figures showing in sequence the release operation of one of the locking members of the present invention.

With reference to FIG. 1, there is shown a typical rocket 10, having a forward end 12 and a rear exhaust end 14, being launched from a launch tube 16, which in like manner has a forward end 18 and a rear end 20. As indicated previously herein, it is a common practice to carry the rocket 10 within the launch tube 16 to the location of use. Thus, the tube 16 serves the dual function of a container for the rocket 10 during transport, and also as a launching device during use.

The present invention comprises a releasable locking assembly, generally designated 22, comprising two locking members 24 and a retaining strut 26. This locking assembly 22 holds the rocket 10 securely in the tube 16 during transport or storage; upon firing the rocket, the locking assembly 22 automatically releases the rocket from the tube, with the component parts of the locking assembly being blown rearwardly from the tube to permit the uninterrupted flow of gaseous exhaust from the rearend of the tube 16.

Each locking member 24 is in the form of a single rigid piece and is provided with a related spring member 28. The two locking members 24, have a first locking position, where the two members 24 are positioned within the rear end of the tube 16 on diametrically opposed sides of the rear end of the rocket 10. To disclose the details of the two locking members 24 and their associated springs 28, the description will be limited to the locking member 24 which is shown at the top portion of the tube 16, as seen in FIGS. 2 through 5. In presenting this description, the terms "upper" and "lower" will refer to proximity to the portions of FIGS. 2 through 5 which appear on the upper or lower parts of the drawings.

Thus, it can be seen that the upper locking member 24 has a forward swing end 30, a rear swing end 32 and an intermediate pivot location 34. The vertical thickness at the pivot location 34 is at a maximum, and the member 24 tapers moderately in a radial direction in a forward and rearward direction. Further, the dimension of the pivot location 34 is so selected that its upper portion 36 through the spring member 28 bears against the inside surface of the tube 16 and the lower portion 38 of the location 34 through the spring member 28 bears against the outside surface of the rocket 10, when the rocket 10 is in its stored position and locked in place. Further, when the upper locking member 24 is in its locking position, the upper rear surface portion 40 through the spring member 28 bears against the inside surface of the tube 16, and its forward lower surface portion 42 through the spring member 28 bears against the upper outer surface portion of the rocket 10.

The previously mentioned spring member 28 is in the form of a leaf spring, and it has a forward end 44 having an anchoring flange 46 which lies against the forward lower surface portion 42 of the locking member 24. The flange 46 is secured to the member 24 by means of a bolt 48. The downwardly and outwardly protruding head 50 of the bolt 48 serves as a locking element which extends into a mating recess in the outer surface of the rocket 10, this recess being indicated at 51.

From the anchoring flange 46, the spring member 28 extends around the forward end 30 of the member 24, past the upper pivot portion 36, and thence rearwardly along the upper surface 40 of the member 24. This rearwardly extending portion of the spring member 28 comprises a spring arm 52 which, when the locking member 24 is in its locking position, is interposed snugly between the upper rear surface 40 of the member 24 and the upper inner surface of the tube 16.

At the upper rear portion of the member 24, there is an upwardly extending protrusion 54 which serves as a second locking element on the member 24. With the member 24 in its locked position, this locking element 54 fits in a matching recess 56 formed in the tube 16. Also, the rear portion of the spring arm 52 has an upwardly extending spring retaining finger 58 which also reaches into the recess 56 directly in front of and contiguous to the locking element 54. When the member 24 is in its locking position, the locking element 54 and spring retaining finger 58 both fit snugly in the related recess 56. The extreme rear end of the spring arm 52 is formed as two resilient spring release fingers 60, positioned on opposite sides of the locking element 54. As will be disclosed more fully hereinafter, these two release fingers 60 press against the upper inner surface of the tube 16 so as to move the spring retaining finger 58 free of the recess 56 after release of the rocket 10.

The retaining strut 26, as its name implies, serves the function of retaining the two locking members 24 in their locking position. The lower rear end of the upper locking member 24 is formed with a retaining slot 62 to receive the upper edge 64 of a web portion 66 of the strut 26. The strut 26 is also provided with two lateral flanges 68 which provide the necessary structural rigidity to the strut 26. The upper and lower ends of the two flanges 68 fit on opposite sides of the rear ends of the upper and lower locking members 24 to maintain the strut 26 in proper retaining engagement with the members 24.

With the locking assembly 22 in its locking position as shown in FIG. 2, the retaining strut 26 holds the rear portion of the upper and lower locking members 24 radially outwardly against the tube 16. The two forward locking elements 50 (which as indicated earlier are the two bolt heads 50 of the two bolts 48) hold the two locking members 24 in locking engagement with the rocket 10, while the two second locking elements 54 hold the two locking members 24 in locking engagement with the tube 16. The retaining strut 26 has sufficient structural rigidity and strength so that the normal impact loads on the tube 16 during transport would not be sufficient to break or dislodge the retaining strut 26.

To describe the release operation of the locking assembly 22, it will be noted that the retaining strut 26 is positioned immediately behind the exhaust end 14 of the rocket 10. While this strut 26 is made sufficiently strong to resist normal impact loads on the tube 16 the strength of the strut 26 is not so great as to withstand the blast from the exhaust from the rocket 10. This can be accomplished either by properly selecting the initial dimensions and material of the strut 26, or possibly by scoring or otherwise weakening the structure of the strut 26 at the middle portion thereof. At any rate, when the rocket 10 is fired, the exhaust from the rocket 10 impinges on the strut 26 to fracture the strut 26 and blow it rearwardly from the tube 16.

The blowing out or removal of the strut 26 from its retaining position from the aft end of the tube 16 is illustrated in FIG. 3. The immediate effect of this is to permit the two spring arms 52 of the two locking members 24 to push the rear end of its related member 24 radially inwardly. Since each member 24 is in effect pivotally mounted at its intermediate portion 34 between the tube 16 and rocket 10, as the rear end of the member 24 pivots radially inwardly, so as to move the second locking element 54 out of locking engagement with its related recess 56, the forward end of each locking member 24 moves radially outwardly so that the two forward locking elements 50 move out of locking engagement with the rocket 10.

Figure 4:
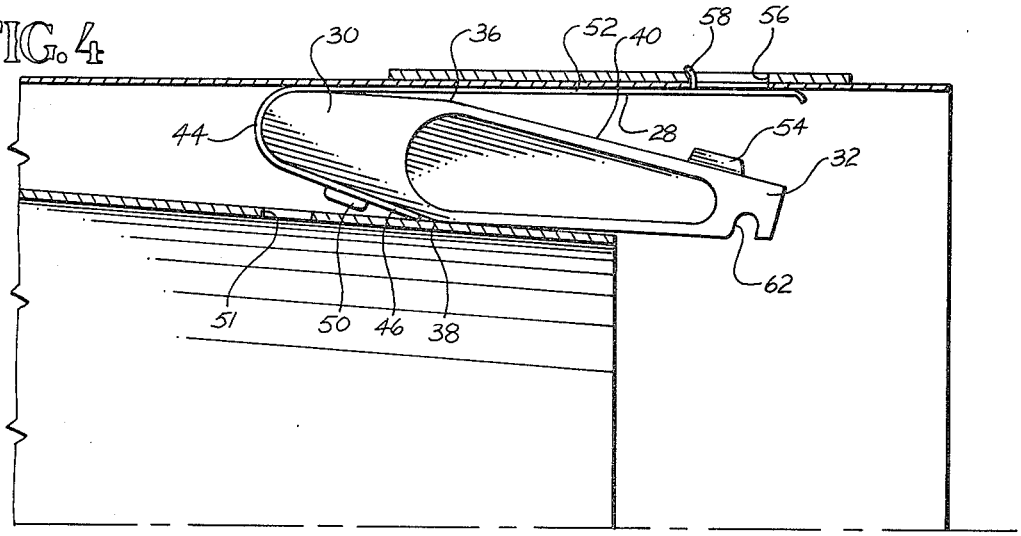
Figure 5:
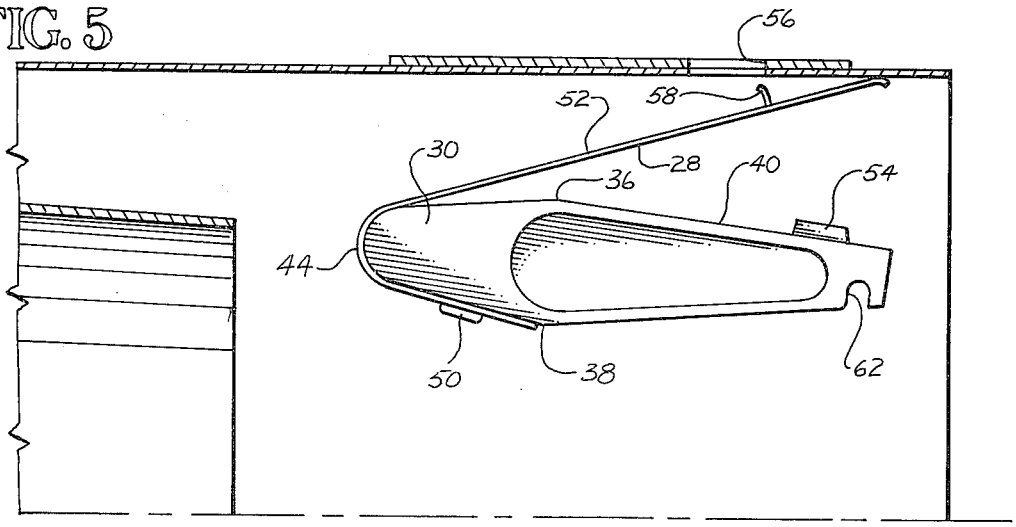
Figure 6:
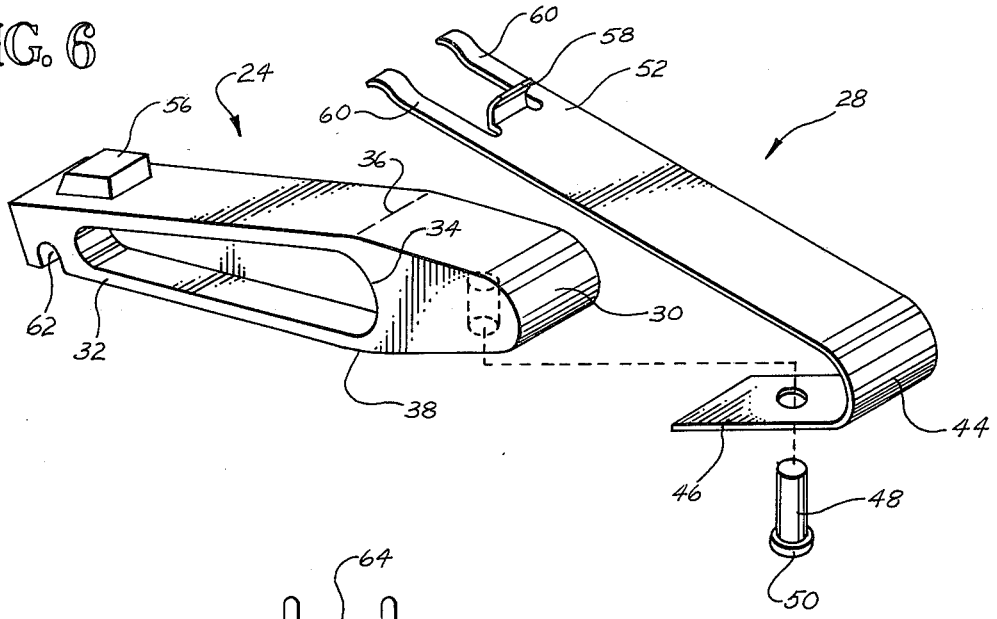
FIG. 6 is an isometric view illustrating one of the locking members of the present invention, with its associated release spring being separated from the locking member for purposes of illustration.
Figure 7:
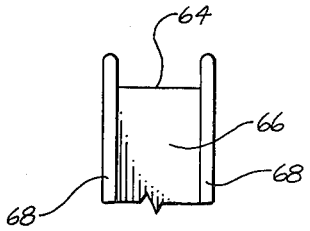
FIG. 7 is a rear view of the upper end portion of the retaining strut of the present invention.

By the time the two spring arms 52 have moved the two locking members completely out of locking engagement (as shown in FIG. 4), the rocket 10 then begins to move forwardly in the launch tube 16, with the retaining fingers 58 preventing forward movement of the members 24 (see FIG. 4). As the rear edge of the rocket moves past the forward end of the two locking members 24, the remaining spring action of the two spring arms 52 push the two locking members 24 further radially inwardly and into the path of the rocket exhaust. At the same time, the two sets of spring release fingers 60 move the two spring retaining fingers 58 out of the recesses 56 so that the two locking members 24 with their spring members 28 are totally free of any locking or retaining engagement with the tube 16. At this time, the exhaust from the rocket 10 blows the two locking members 24 with their springs 28 out of the aft end of the tube 16, so that there is an uninterupted flow of rocket exhaust out the aft end of the tube 16.

I claim:

1. In combination with a rocket launching assembly having:

a. an elongate launching tube having a forward launching end and a rear exhaust end, and b. a rocket having a forward end and a rear exhaust end, and adapted to be carried within and launched from said tube, a locking assembly to releasably retain said rocket in said tube prior to launch, and to release said rocket for launch, said locking assembly comprising:

a. at least one locking member mounted to said tube and having a first engaged position where the locking member engages the rocket in locking relationship, and a second release position where said locking member releases the rocket for launch, b. spring means urging said locking member toward its release position, c. a retaining member having a retaining position in which the retaining member holds said locking member in its engaged position in opposition to said spring means, d. said retaining member being further characterized in that the retaining member has a release portion thereof mounted adjacent the exhaust end of said rocket in a manner that exhaust from said rocket causes movement of said release portion to move said retaining member from its retaining position, so as to permit said spring means to move said locking member to its release position, e. said locking member being pivotally mounted in said tube in a manner to have a first swing end and a second swing end, said first swing end having a locking element thereon engaging said rocket and movable in a radially outward direction toward said release position, said second swing end being urged by said spring member in a radially inward direction toward said release position, said retaining member engaging said second swing end in a manner to prevent said second swing end from moving inwardly when said retaining member is in its retaining position, whereby upon said retaining member being moved from its retaining position, said spring means causes said second swing end to swing inwardly, thus causing said first swing end to move outwardly to said release position, f. said locking member being positioned between an inner surface of said tube and an outer surface of said rocket, said locking member having a middle portion of greater dimension in a radial direction, with said first swing end and said second swing end both having smaller dimensions in a radial direction, whereby said locking member is pivotally mounted within said tube by means of its middle portion pivotally engaging said tube and said rocket, whereby prior to firing of said rocket, said locking member reliably holds said rocket in said tube, and upon firing of said rocket, exhaust gases from said rocket move the retaining member from its retaining position to permit the spring means to move the locking member to its release position and thus permit the rocket to be launched from the tube.

2. The assembly as recited in claim 1, wherein in said engaged position, said locking element extends radially inwardly from the first swing end to engage said rocket.

3. The assembly as recited in claim 2, wherein said spring means comprises a resilient spring member mounted to said locking member and extending from the middle portion of the locking member toward said second swing end of the locking member, said spring member being yieldingly urged to a position away from said second swing end and positioned between said tube and said locking member, in a manner that said spring member urges said second swing end of the locking member radially inwardly.

4. The improvement as recited in claim 3, wherein said spring member comprises a leaf spring attached to the first swing end of said locking member and extending across the middle portion of the locking member toward the second swing end of the locking member.

5. The assembly as recited in claim 3, wherein said spring member has a retaining finger means releasably engaging said tube, said spring member being arranged so that when said locking member is moved toward its release position, said retaining finger means is moved out of engagement with said tube.

6. The assembly as recited in claim 5, wherein said tube is provided with a retaining recess, said second swing end of the locking member having a second locking element positioned in said retaining recess when said locking member is in its engaged position.

7. The assembly as recited in claim 6, wherein said retaining finger means is also positioned in said retaining recess, in a manner that upon release by said retaining member, said spring member first moves said second locking element out of engagement with said locking recess, and thereafter said retaining finger means moves out of engagement with said locking recess.

8. In combination with a rocket launching assembly having:

a. an elongate launching tube having a forward launching end and a rear exhaust end, and b. a rocket having a forward end and a rear exhaust end, and adapted to be carried within and launched from said tube, a locking assembly to releasably retain said rocket in said tube prior to launch, and to release said rocket for launch, said locking assembly comprising:

a. at least one locking member mounted to said tube and having a first engaged position where the locking member engages the rocket in locking relationship, and a second release position where said locking member releases the rocket for launch, b. spring means urging said locking member toward its release position, c. a retaining member having a retaining position in which the retaining member holds said locking member in its engaged position in opposition to said spring means, d. said retaining member being further characterized in that the retaining member has a release portion thereof mounted adjacent the exhaust end of said rocket in a manner that exhaust from said rocket causes movement of said release portion to move said retaining member from its retaining position, so as to permit said spring means to move said locking member to its release position, e. said spring means comprising a resilient spring member mounted to said locking member and extending from one portion of the locking member toward a tube engaging swing end of the locking member, said spring member being yieldingly urged to a position away from said tube engaging end and positioned between said tube and said locking member, in a manner that said spring member urges said tube engaging swing end of the locking member radially inwardly, f. said spring member comprising a leaf spring attached to a rocket engaging swing end of said locking member and extending across a middle portion of the locking member toward the tube engaging swing end of the locking member, whereby prior to firing of said rocket, said locking member reliably holds said rocket in said tube, and upon firing of said rocket, exhaust gases from said rocket move the retaining member from its retaining position to permit the spring means to move the locking member to its release position and thus permit the rocket to be launched from the tube.

9. In combination with a rocket launching assembly having:

a. an elongate launching tube having a forward launching end and a rear exhaust end, and b. a rocket having a forward end and a rear exhaust end, and adapted to be carried within and launched from said tube, a locking assembly to releasably retain said rocket in said tube prior to launch, and to release said rocket for launch, said locking assembly comprising:

a. at least one locking member mounted to said tube and having a first engaged position where the locking member engages the rocket in locking relationship, and a second release position where said locking member releases the rocket for launch, b. spring means urging said locking member toward its release position, c. a retaining member having a retaining position in which the retaining member holds said locking member in its engaged position in opposition to said spring means, d. said retaining member being further characterized in that the retaining member has a release portion thereof mounted adjacent the exhaust end of said rocket in a manner that exhaust from said rocket causes movement of said release portion to move said retaining member from its retaining position, so as to permit said spring means to move said locking member to its release position, e. said spring means comprising a resilient spring member mounted to said locking member and extending from one portion of the locking member toward a tube engaging swing end of the locking member, said spring member being yieldingly urged to a position away from said tube engaging end and positioned between said tube and said locking member, in a manner that said spring member urges said tube engaging swing end of the locking member radially inwardly, f. said spring member having a retaining finger means releasably engaging said tube, said spring member being arranged so that when said locking member is moved toward its release position, said retaining finger means is moved out of engagement with said tube, whereby prior to firing of said rocket, said locking member reliably holds said rocket in said tube, and upon firing of said rocket, exhaust gases from said rocket move the retaining member from its retaining position to permit the spring means to move the locking member to its release position and thus permit the rocket to be launched from the tube.

10. The assembly as recited in claim 9, wherein said tube is provided with a retaining recess, said tube engaging swing end of the locking member having a tube engaging locking element positioned in said retaining recess when said locking member is in its engaged position.

11. The assembly as recited in claim 10, wherein said retaining finger means is also positioned in said retaining recess, in a manner that upon release by said retaining member, said spring member first moves said tube engaging locking element out of engagement with said retaining recess, and thereafter said releasable retaining finger means moves out of engagement with said retaining recess.

12. In combination with a rocket launching assembly having:

a. an elongate launching tube having a forward launching end and a rear exhaust end, and b. a rocket having a forward end and a rear exhaust end, and adapted to be carried within and launched from said tube, a locking assembly to releasably retain said rocket in said tube prior to launch, and to release said rocket for launch, said locking assembly comprising:

a. a pair of locking members mounted to said tube in diametrically opposed relationship on opposite sides of said rocket, each locking member having a first engaged position where each locking member engages the rocket in locking relationship, and a second release position where each locking member releases the rocket for launch, b. spring means for each locking member urging its related locking member toward its release position, c. a retaining member having a retaining position in which the retaining member holds said locking members in their engaged position in opposition to said spring means, d. said retaining member being further characterized in that the retaining member has a release portion thereof mounted adjacent the exhaust end of said rocket in a manner that exhaust from said rocket causes movement of said release portion to move said retaining member from its retaining position, so as to permit said spring means to move the locking members to their release positions, e. said locking members each being pivotally mounted in said tube in manner to have a first swing end and a second swing end, said first swing end having a locking element thereon engaging said rocket and movable in a radially outward direction toward said release position, said second swing end being urged by its related spring member in a radially inward direction toward said release position, said retaining member engaging said second swing end in a manner to prevent said second swing end from moving inwardly when said retaining member is in its retaining position, whereby upon said retaining member being moved from its retaining position, said spring means causes said second swing end to swing inwardly, thus causing said first swing end to move outwardly to said release position, f. each locking member being positioned between an inner surface of said tube and an outer surface of said rocket, each locking member having a middle portion of greater dimension in a radial direction, with said first swing end and said second swing end both having smaller dimensions in a radial direction, whereby each locking member is pivotally mounted within said tube by means of its middle portion pivotally engaging said tube and said rocket, whereby prior to firing of said rocket, said locking members reliably hold said rocket in said tube, and upon firing of said rocket, exhaust gases from said rocket move the retaining member from its retaining position to permit the spring means to move the locking members to their release positions and thus permit the rocket to be launched from the tube.

13. The assembly as recited in claim 12, wherein in said engaged position, each locking element extends radially inwardly from the first swing end to engage said rocket.

14. The assembly as recited in claim 13, wherein each of said spring means comprises a resilient spring member mounted to its locking member and extending from the middle portion of its locking member toward said second swing end of its locking member, each spring member being yieldingly urged to a position away from said second swing end and positioned between said tube and said locking member, in a manner that each spring member urges its second swing end of the locking member radially inwardly.

15. The assembly as recited in claim 14, wherein each spring member comprises a leaf spring attached to the first swing end of its locking member and extending across the middle portion of its locking member toward the second swing end of its locking member.

16. The assembly as recited in claim 13, wherein each spring member has a retaining finger means releasably engaging said tube, each spring member being arranged so that when its locking member is moved toward its release position, said retaining finger means is moved out of engagement with said tube.

17. The assembly as recited in claim 16, wherein said tube is provided with a pair of retaining recesses, said second swing end of each locking member having a second locking element positioned in its related retaining recess when said locking member is in its engaged position.

18. The assembly as recited in claim 17, wherein each retaining finger means is also positioned in its related retaining recess, in a manner that upon release by said retaining member, each spring member first moves its related second locking element out of engagement with its locking recess, and thereafter each retaining finger means moves out of engagement with its locking recess.

19. In combination with a rocket launching assembly having:

a. an elongate launching tube having a forward launching end and a rear exhaust end, and b. a rocket having a forward end and a rear exhaust end, and adapted to be carried within and launched from said tube, a locking assembly to releasably retain said rocket in said tube prior to launch, and to release said rocket for launch, said locking assembly comprising:

a. a pair of locking members mounted to said tube in diametrically opposed relationship on opposite sides of said rocket, each locking member having a first engaged position where each locking member engages the rocket in locking relationship, and a second release position where each locking member releases the rocket for launch, b. spring means for each locking member urging its related locking member toward its release position, c. a retaining member having a retaining position in which the retaining member holds said locking members in their engaged position in opposition to said spring means, d. said retaining member being further characterized in that the retaining member has a release portion thereof mounted adjacent the exhaust end of said rocket in a manner that exhaust from said rocket causes movement of said release portion to move said retaining member from its retaining position, so as to permit said spring means to move the locking members to their release positions, e. each spring means comprising a resilient spring member mounted to its locking member and extending from one portion of its locking member toward a tube engaging swing end of its locking member, each spring member being yieldingly urged to a position away from said tube engaging end and positioned between said tube and said locking member, in a manner that each spring member urges said tube engaging swing end of its locking member radially inwardly, each spring member further comprising a leaf spring attached to a rocket engaging swing end of its related locking member and extending across a middle portion of its locking member toward the tube engaging swing end of its locking member, whereby prior to firing of said rocket, said locking members reliably hold said rocket in said tube, and upon firing of said rocket, exhaust gases from said rocket move the retaining member from its retaining position to permit the spring means to move the locking members to their release positions and thus permit the rocket to be launched from the tube.

20. The assembly as recited in claim 19, wherein each spring member has a retaining finger means releasably engaging said tube, each spring member being arranged so that when its related locking member is moved toward its release position, said retaining finger means is moved out of engagement with said tube.

21. The assembly as recited in claim 20, wherein said tube is provided with a pair of retaining recesses, said tube engaging swing end of each locking member having a tube engaging locking element positioned in its related retaining recess when its locking member is in its engaged position.

22. The assembly as recited in claim 20, wherein each retaining finger means is also positioned in its related retaining recess, in a manner that upon release by said retaining member, each spring member first moves its tube engaging locking element out of engagement with its retaining recess, and thereafter each releasable retaining finger means moves out of engagement with its retaining recess.

23. In combination with a rocket launching assembly having:

a. an elongate launching tube having a forward launching end and a rear exhaust end, and b. a rocket having a forward end and a rear exhaust end, and adapted to be carried within and launched from said tube, a locking assembly to releasably retain said rocket in said tube prior to launch, and to release said rocket for launch, said locking assembly comprising:

a. at least one locking member mounted to said tube and having a first engaged position where the locking member engages the rocket in locking relationship, and a second release position where said locking member releases the rocket for launch, b. spring means urging said locking member toward its release position, c. a retaining member having a retaining position in which the retaining member holds said locking member in its engaged position in opposition to said spring means, d. said retaining member being further characterized in that the retaining member has a release portion thereof mounted adjacent the exhaust end of said rocket in a manner that exhaust from said rocket causes movement of said release portion to move said retaining member from its retaining position, so as to permit said spring means to move said locking member to its release position, e. releasable connecting means having a first connecting position connecting said locking member to said tube when said locking member is in its first engaged position, and a second disengaged position to disengage the locking member from the tube when said locking member is in its second release position to permit said locking member to move from said tube, whereby prior to firing of said rocket, said locking member reliably holds said rocket in said tube, and upon firing of said rocket, exhaust gases from said rocket move the retaining member from its retaining position to permit the spring means to move the locking member to its release position and thus permit the rocket to be launched from the tube.

24. The assembly as recited in claim 23, wherein said spring means has a retaining finger means releasably engaging said tube, said spring member being arranged so that when said locking member is moved toward its release position, said retaining finger means is moved out of engagement with said tube.

25. The assembly as recited in claim 23, wherein said locking member is pivotally mounted in said tube so as to be rotatable to its second release position, said releasable connecting means being rotatably moveable with said locking member so as to be moved to its disengaged position by rotation of said locking member.

26. The assembly as recited in claim 25, wherein said releasable connecting means comprises a connecting member adapted to fit in a matching recess in said tube.

27. The assembly as recited in claim 25, wherein said spring means has a retaining finger means releasably engaging said tube, said spring member being arranged so that when said locking member is moved toward its release position, said retaining finger means is moved out of engagement with said tube.

28. A locking device adapted to be used in a rocket launching assembly to retain a rocket in a launch tube prior to launch, and to release said rocket for launch, said device comprising:

a. a locking member comprising:

1. a first swing end portion having a locking element adapted to releasably engage said rocket in locking relationship,
2. a second swing end portion having a releasable connecting member adapted to releasably engage said tube,
3. an enlarged intermediate portion of greater dimension adapted to be positioned pivotally between said rocket and said launch tube in a manner to permit rotational movement of said locking member from a first engaged position where the locking member engages the rocket and tube in locking relationship and a disengaged position where said locking member becomes disengaged from both said tube and said sprocket, b. a spring member mounted on said locking member and positioned to spring outwardly from said locking member in a manner that with said locking member mounted in its engaged position said spring member urges said locking member from its engaged position to its disengaged position.

29. The device as recited in claim 28, wherein said spring member extends from the intermediate portion of the locking member toward said second swing end of the locking member, with said spring member being biased to a position away from said second swing end in a manner that with said locking member in its engaged position, said spring member urges said second swing end of the locking member away from the tube.

30. The device as recited in claim 29, wherein said spring member comprises a leaf spring attached to the first swing end of said locking member and extending across the middle portion of the locking member toward the second swing end of the locking member.

31. The device as recited in claim 29, wherein said spring member has a retaining finger extending away from said tube, said retaining finger being adapted to engage said tube when the locking member is in its engaged position and move out of engagement with said tube when said locking member moves to its disengaged position.

* * * * *